US009752810B1

(12) United States Patent
Jacobson et al.

(10) Patent No.: US 9,752,810 B1
(45) Date of Patent: Sep. 5, 2017

(54) REFRIGERATION UNIT TEMPERATURE ALARM USING THERMAL PROPERTIES OF FOOD TO ELIMINATE FALSE ALARMS

(71) Applicants: Ronald Charles Jacobson, Miami, FL (US); Gregory Scott Lingerfelt, Woodstock, GA (US)

(72) Inventors: Ronald Charles Jacobson, Miami, FL (US); Gregory Scott Lingerfelt, Woodstock, GA (US)

(73) Assignee: VERSID, INC., Miami, FL (US)

( * ) Notice: Subject to any disclaimer, the term of this patent is extended or adjusted under 35 U.S.C. 154(b) by 0 days.

(21) Appl. No.: 14/926,238

(22) Filed: Oct. 29, 2015

Related U.S. Application Data

(60) Provisional application No. 62/072,095, filed on Oct. 29, 2014.

(51) Int. Cl.
*G08B 1/08* (2006.01)
*F25B 49/00* (2006.01)

(52) U.S. Cl.
CPC ..... *F25B 49/005* (2013.01)

(58) Field of Classification Search
CPC ..... F25B 49/005
USPC ..... 340/585, 539.22, 539.26, 539.27, 584, 340/870.17; 62/127, 129
See application file for complete search history.

(56) References Cited

U.S. PATENT DOCUMENTS 5,798,694 A * 8/1998 Reber ..... B65D 77/24 340/10.41
6,502,409 B1 1/2003 Gatling et al.
6,892,545 B2 5/2005 Ishikawa et al.
6,919,795 B2 7/2005 Roseen
7,024,870 B2 * 4/2006 Singh ..... A23G 9/00 165/11.2
7,026,929 B1 * 4/2006 Wallace ..... G08B 25/009 340/539.13
7,834,774 B2 11/2010 Stevens et al.
7,861,542 B2 1/2011 Rozendaal et al.
8,063,735 B2 11/2011 Shoenfeld
8,065,886 B2 11/2011 Singh et al.
8,172,458 B2 5/2012 Petrakis
2003/0132841 A1 * 7/2003 Alderman ..... G08B 7/06 340/545.6
2006/0061454 A1 3/2006 Debord et al.
2009/0237258 A1 * 9/2009 Heck ..... H04Q 9/00 340/585

* cited by examiner

*Primary Examiner* — Brent Swarthout
(74) *Attorney, Agent, or Firm* — Malin Haley DiMaggio & Bowen, P.A.

(57) ABSTRACT

A temperature sensing system for refrigeration and related methodology. The system has a refrigeration unit containing one or more food products, a temperature sensor disposed in the refrigeration unit. The temperature sensor is in communication with a remote computing device that is configured to calculate thermal data pertaining to said one or more food products. The remote computing device in communication with a temperature monitor that receives real-time temperature information from the temperature sensor. The monitor includes an alarm function that is activated if temperature inside said refrigeration unit causes a rise of the actual product temperature above a specified threshold such as 41° F. while noting the time remaining to return the product temperature to a safe level within the government specified 4 hour limit.

5 Claims, 1 Drawing Sheet

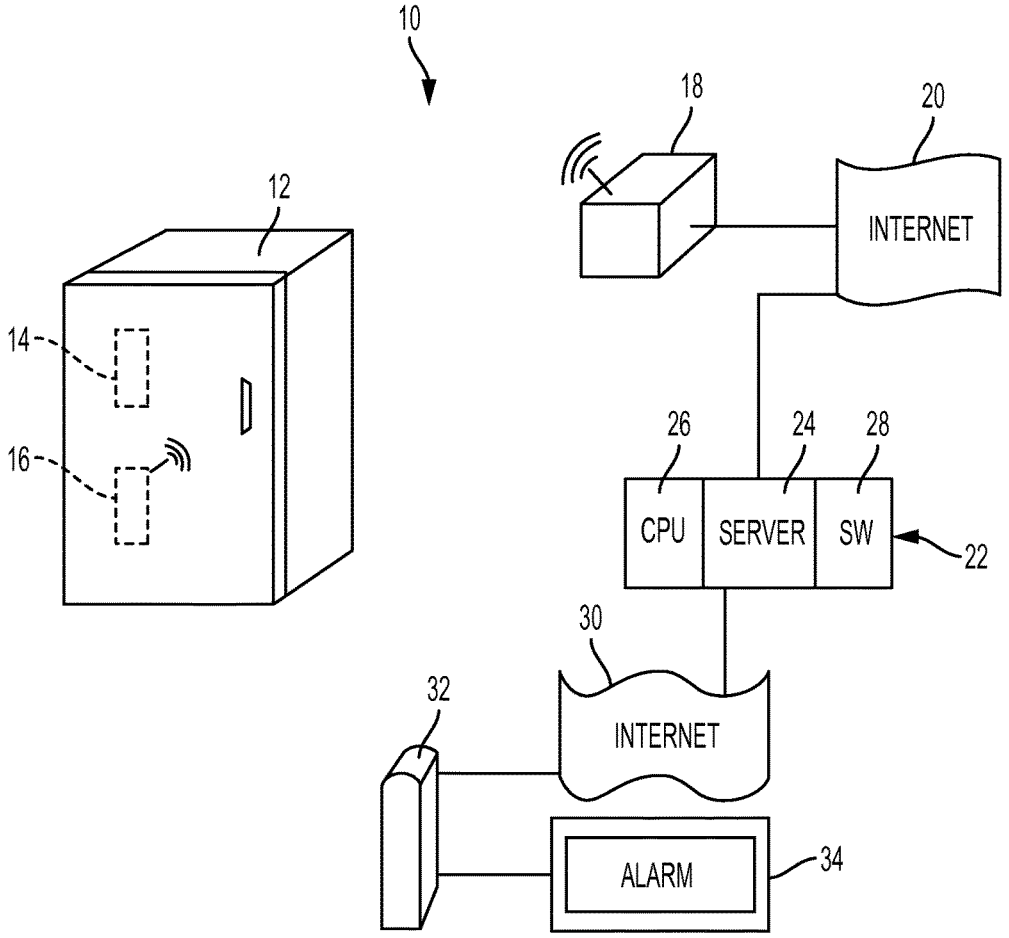
10
18
20
INTERNET
12
14
16
26
24
28
CPU
SERVER
SW
22
30
32
INTERNET
ALARM
34

REFRIGERATION UNIT TEMPERATURE ALARM USING THERMAL PROPERTIES OF FOOD TO ELIMINATE FALSE ALARMS

BACKGROUND OF THE INVENTION

Field of the Invention

This invention relates generally to a notification and alarm system and method to monitor the temperature of refrigerated and frozen foods in order to prevent spoilage while eliminating unnecessary false alarms caused by temperature variations within the refrigeration monitored environment, and specifically to a refrigerated food temperature responsive alarm system and method that includes a food specific thermal energy properties monitoring software program eliminating false alarms.

Description of Related Arts

The remote monitoring of refrigerated foods to prevent spoilage is well known in the prior art. Refrigeration unit internal temperature sensors mounted within refrigerators containing food products that require refrigeration (often below 41° F. or freezing temperatures) can provide periodic information to remotely located computers and work stations that include alarms to notify remote observers that a particular refrigeration unit and the temperature inside exceed some threshold value such as 41° F. that could endanger or spoil the food contained in the refrigeration unit.

While this information is very helpful to prevent food spoilage, because of momentary or short time temperature fluctuations within any particular refrigeration unit, monitoring and handling false alarms can be very costly for large organizations that have numerous refrigeration units. For example, a defrost cycle can result in a 3 to 5° F. rise in internal temperature of a refrigeration unit for a short period of time. Some temperature fluctuations within a single refrigeration unit will not cause food spoilage based on the type of food, the food packaging, the temperature change in the refrigeration unit, and the time period involved. It is not uncommon for a refrigeration unit to go through some type of internal process that may cause a momentary or very short period of time elevation of the temperature inside the refrigeration unit above a threshold alarm value. If someone accidentally leaves a refrigeration unit door open for an excessive time, there will be a momentary rise in the temperature inside the refrigeration unit until the open door error is determined. Many of these situations cause a rise in temperature that is not harmful to the stored food and, therefore, results in a false alarm, rising to a nuisance.

The refrigeration remote sensing and alarm system to protect refrigerated foods is an extremely important system to protect against food spoilage for large organizations that are responsible for food products to be safely consumed by the public. However, false alarms based on a refrigeration unit that exceeds a threshold value for a period of time which does not affect the safety of the food product being refrigerated can be very expensive in terms of the monitoring and alarm system operations.

The remote refrigerated food sensor and alarm system described by the invention herein is purposed to eliminate or greatly reduce false alarms that may arise from temperature variations in a refrigeration unit that would not cause spoilage or affect the safety of the food stored therein.

It is, therefore, to the effective resolution of the aforementioned problems and shortcomings of the prior art that the present invention is directed. However, in view of food preparation and packaging processes in existence at the time of the present invention, it was not obvious to those persons of ordinary skill in the pertinent art as to how the identified needs could be fulfilled in an advantageous manner.

SUMMARY OF THE INVENTION

A refrigeration unit containing one or more specific food products is monitored remotely to ensure that the temperature inside the refrigeration unit does not exceed 41° Fahrenheit or a predetermined temperature below freezing i.e. 32 degrees F. If there are packages of the same food product in the refrigeration unit, the thermal properties of that single food product and package are calculated. If there are a variety of different food products within the refrigeration unit, a specific food product that represents the worst-case scenario as far as temperature sensitivity is selected and its thermal properties are calculated to determine temperature, heating, shelf life time, and time to reach a certain temperature. The thermal properties as calculated are stored in a database and a computer program used in conjunction with temperature monitoring and alarm sending.

The specific food thermal property calculations database and software computer program are used in a server that is the heart of the temperature monitor and alarm system that can be connected to the Internet and receive temperature information from a remote refrigeration unit that has a temperature sensor inside the refrigeration unit. The temperature sensor inside the refrigeration unit monitors the actual temperature inside the refrigeration unit continuously and periodically sends the temperature information using a wireless signal to a local area network near the refrigeration unit. The local area network is connected to the Internet and, in turn, the monitor and alarm server.

Using the computer program that contains calculated data regarding the thermal properties of a particular food and thermal properties of the food that is in the refrigeration unit packaging, the server can monitor actual temperatures in the refrigeration unit and if a threshold value of temperature is exceeded, calculate whether there is an actual danger of food spoilage sufficient to trigger the alarm. The server can periodically provide real-time data to the customer using the Internet in the customer's computer or cell phone for current status or to notify the user customer of an alarming condition that could result in food spoilage.

Also provided is a food spoilage alarm system and method to monitor refrigerated foods remotely to prevent spoilage while eliminating unnecessary false alarms caused by temperature fluctuations exceeding a threshold value in a refrigeration unit monitored environment. In some embodiments, the system comprises a refrigeration unit, a temperature sensor and monitor mounted inside the refrigeration unit, a temperature sensor information transmitter, a local area network for receiving the temperature sensor information and transmitting the real-time temperature information over the Internet, a temperature monitor server including a CPU, data processor and communication device connected to the temperature sensor and monitor, and a specific food product stored within said refrigeration unit that is monitored by the system and method.

A computer program uses the thermal properties of a specific food product and food product packaging to calculate the predicted specific food product temperature while the food product is in a cooler or a freezer. The computer program analyzes numerous variables including discharge air temperature of the refrigeration unit, specific heat of the food product, bulk density and moisture content of the product, heat transfer coefficients, time intervals, surface area of the food product (packaging) and the volume of the food product. Using this information the thermal properties and size of a specific food product is defined inside of the computer program database and can be used when the operator assigns a specific food product and specific volume to the refrigeration sensor monitor system.

The computer program also establishes and calculates another important temperature which is the temperature of the specific food product that determines a period of time for a specific food product at one temperature to reach a different temperature. This process analyzes discharge air temperature, specific heat of a product, bulk density of the product and moisture content of the product, heat transfer coefficient, time intervals, temperature variation, and rate of change, humidity, surface area of the food product package and volume of the food product package. The purpose of this measurement is to provide the time it would take the specific food product to reach a temperature that has changed inside the refrigeration unit. If the temperature inside the refrigeration unit increases to a particular temperature as a result of a failure, the computer program will calculate the time that it would take the food product to reach the danger zone above 41 degrees F.

It is also necessary to determine when a food product temperature goes above a threshold value such as 41° F. or 32 degrees F. to determine how long it will take for the food product to return to 41° F. or 32 degrees or below or how long it will take to correct the temperature. With knowledge of this calculation provided by the computer program, the system can inform an operator if the system is too far out of temperature to reach the threshold value for the food product such that the period of time to correct the temperature will take too long before the food will spoil, indicating that the food product must be used or discarded.

The following information is used by the computer program for this determination which includes discharge air temperature, specific heat of a product, bulk density of the product, heat transfer coefficient, thermal conductivity, and the surface area of the product package and the volume of the food product.

The system and method described herein for protecting food from spoilage and remote sensor and monitor system for refrigeration unit requires only a real-time temperature reading inside a specific refrigeration unit and the information described above to determine the parameters of a specific food product. The computer program can use a temperature reading only with the knowledge of a specific product and volume of the product to determine whether or not it is necessary to send out an alarm.

With respect to a particular refrigeration unit, the worst-case scenario can be used with respect to the refrigeration unit containing a variety of different food products of different sizes. The temperature sensing and monitoring system for a particular refrigeration unit monitors temperatures and then will use the most sensitive food product analysis when determining whether or not to sound the alarm based on temperature variations in a refrigeration unit that exceed a threshold value that would indicate a problem that could cause spoilage. The monitoring system includes an alarm function that is activated if the temperature inside the refrigeration unit causes a rise of the actual product temperature above a specified threshold such as 41° F. while noting the time remaining to return the actual product temperature to a safe level within the government specified four hour limit.

In some embodiments, the present invention provides a temperature sensing system for refrigeration, comprising at least one refrigeration unit containing one or more food products, a temperature sensor disposed in said refrigeration unit. The temperature sensor is in communication with a remote computing device that is configured to calculate thermal data pertaining to said one or more food products. The remote computing device in communication with a temperature monitor that receives real-time temperature information from the temperature sensor. The monitor includes an alarm function that is activated if temperature inside said refrigeration unit cannot be returned to a safe level before the food product spoils.

Also described is a method for sensing and correcting the temperature of a refrigeration unit, comprising the steps of providing the refrigeration unit having an initial inside temperature below a threshold value; providing one or more food products into the refrigeration unit; providing the said refrigeration unit a temperature sensing unit that measures the inside air temperature of the refrigeration unit; establishing a communications link between the temperature sensing unit and a remote computing device that is configured to determine thermal properties of said one or more food products; transmitting from the temperature sensing unit to the remote computing device, temperature data corresponding to the inside air temperature of the refrigeration unit; upon detection by the temperature sensing unit of a temperature above the threshold value, determining on the computing device based on the thermal properties, the time needed for the one or more food products to spoil; determining on the computing device based on the thermal properties, the time needed for the one or more food products to return to the threshold value; and providing an alarm signal if the computing device determines that the time needed for the one or more food products to spoil is less than time needed for the one or more food products to return to said threshold value.

BRIEF DESCRIPTION OF THE DRAWING

FIG. 1 shows a schematic diagram of the system in accordance with the invention.

DETAILED DESCRIPTION OF THE PREFERRED EMBODIMENT OF THE INVENTION

Referring now to the drawing and in particular FIG. 1, one embodiment of the overall system 10 is shown. Included is a refrigeration unit 12 that has contained therein a specific food package 14 that is being refrigerated and a temperature sensor 16 that monitors the real-time temperature inside the refrigerator 12. The temperature sensor 16 can send a wireless signal of actual temperature data to a local area network or supplied access point 18. The temperature data is transmitted over the Internet 20 to a remote computing device 22 having a server 24, and a central processing unit (CPU) 26 containing a database and a computer software program 28 that calculates thermal data of the specific food product 14. The computing device 22 is also attached to the Internet 30 which is connected to a customer computer 32 that includes a monitor 34 that can receive real-time information concerning the food product 14 contained in refrigeration unit 12. The monitor 34 also includes an alarm function to alert the user of a critical temperature variation that requires action.

In some embodiments, the specific food product 14 in the refrigeration unit 12 is selected to be the worst-case scenario and most sensitive food product contained in the refrigeration unit 12 for the computer program analysis of its thermal properties. This assures a bottom-line fail safe for the system, by monitoring and regulating the temperature of the most sensitive food product. In some embodiments, the refrigeration unit 12 contains only one type of food product 14 and, therefore, the system is programmed for the temperature and condition requirements of that single food product. Computer program 28 includes information corresponding to the thermal properties of the specific food product 14 in order to calculate food temperatures while the food product is in the refrigeration unit 12. The computer program 28 analyzes variables including discharge air temperature of the refrigeration unit, specific heat of the food product, bulk density and moisture content of the product, heat transfer coefficients, time intervals, surface area of the specific food product 14 and packaging, and the volume of the specific food product 14.

The computer program 28 and databases calculate and assign alarm data based on the actual real-time temperature and any temperature change inside the refrigeration unit to determine whether or not there is a danger of food spoilage. The computer program 28 also calculates an important temperature of the specific food product 14 that will determine a period of time for specific food product 14 temperature to reach a different temperature. This process analyzes discharge air temperature and the other variables mentioned including the humidity and the rate of change of temperature variation. The purpose is to determine the amount of time it would take the food product 14 to reach a temperature that has changed inside the refrigeration unit 12. To wit, if the temperature inside the refrigeration unit 12 increases to a particular temperature above a threshold value, the computer program 28 will calculate the time that it would take the food product 14 to reach a spoilage temperature and a period of time to correct the temperature. If the time to reach spoilage is less than the time needed to correct the temperature, the system will trigger the alarm in the monitor 34 of the customer computer 32. Thus, it is also necessary to determine when a food product temperature goes above a threshold value, such as 41° F., to determine how long it will take for the specific food product 14 to return to 41° F. With knowledge of this calculation that is provided by the computer program, the system can inform an operator if the system is too far out of the temperature range to have enough time to correct the temperature for the specific food product 14 to avoid spoilage. Essentially it would take too long to correct the temperature for the food product 14 to remain at a safe temperature indicating that the operator must use or discard the food product 14.

The present invention contemplates various embodiments of a method regulating the temperature inside the refrigeration unit and providing an alarm if a spoilage condition is to occur. First, a refrigeration unit having an inside temperature below a threshold value is provided. Next, food is provided in the refrigeration unit. In some embodiments, the food is homogenous. In other embodiments, a plurality of types of food with different temperature characteristics is provided. Next, a temperature sensing unit is provisioned, wherein the temperature sensing unit can measure the inside air temperature of the refrigeration. The temperature sensing unit further includes a transmitter, such as a network adapter, to transmit temperature data to a local area network that, in some embodiments, is connected to the Internet. The temperature data is passed through to a computer server that includes a central processing unit (CPU), a computer program, and a database wherein the computer program is configured to execute calculations of the thermal properties of the specific food maintained in the refrigeration unit based on the discharge air temperature, specific heat of the food product, bulk density of the food product, moisture content of the food product, heat transfer coefficient, time intervals, time variation, rate of change, humidity, surface area of the food product package, and volume of the food product package. In some embodiments, the calculations executed by the computer program determine a measurement of the time it would take the food product to reach a temperature that has changed inside the refrigeration unit.

After determining the time it will take for the food product to reach the new temperature of the refrigeration unit, the computer program will conduct an analysis of the temperature inside the refrigeration unit as it increases to a particular temperature in order to calculate the time that the specific food product will reach a spoilage temperature. The computer program will then determine when a food product temperature goes above the threshold value to determine how long it will take the food product to return to the threshold value or below. Finally, the computer program will provide an alarm signal to the user if the system variables exceed the safe limit of preserving the food product if the temperature change within the refrigeration unit is beyond the threshold value.

The computer program and databases can generate alarm information based on actual real-time refrigeration unit temperature to determine whether there is a realistic danger of food spoilage to avoid false alarms. The alarm generated information is based on real-time temperatures within a refrigeration unit for a specific food product and will be set off if the computer program and system determine that the time to reach spoilage is less than the time needed to correct the temperature inside the refrigeration unit.

The system and method described herein for protecting food from spoilage requires only a real-time temperature reading inside a specific refrigeration unit and the information described above to determine the parameters of a specific food product and its packaging. In a case with multiple different food products in one refrigeration unit, the worst-case scenario can be used for the most sensitive food product when determining whether or not to sound an alarm based on temperature variations in a refrigeration unit that exceed threshold values of the worst-case scenario which would indicate a problem that could cause spoilage.

The computing systems described herein, such as the CPU 26, servers, and workstations may include a central processing unit (CPU) having a conventional microprocessor, random access memory (RAM) for temporary storage of information, and read only memory (ROM) for permanent storage of "read only" information. A memory controller is provided for controlling system RAM. A bus controller is provided for controlling a data bus, and an interrupt controller is provided for receiving and processing various interrupt signals from the other system components. Data storage may be provided by known non-volatile, removable media storage drives, such as a diskette drives, DVD drives, CD-ROM drives, flash drives, magneto-optical ("MO") drives, and the like, or by non-removable storage systems like hard drives. Data and software may be exchanged with the computing systems via removable media, such as CD-ROMs, DVDs, MO disks, flash drives and the like. The removable media is insertable into a compatible removable media storage drive, which, in turn, utilizes a controller to interface with the data bus. The non-removable storage system is part of a fixed disk drive, which utilizes a hard drive controller to interface with the data bus. User input to the computer may be provided by a number of devices. Examples include a keypad, a keyboard, a mouse, and a trackball, which may be connected to the data bus by an input controller. A direct memory access (DMA) controller is provided for performing direct memory access to system RAM. A visual display may be generated by the graphics subsystem of the computing system that controls the display device attached to the computing system. The display device can be a conventional cathode ray tube ("CRT"), liquid crystal display ("LCD"), light-emitting diode ("LED"), or plasma monitor having individually addressable picture elements ("pixels".) The pixels are arranged in a two-dimensional X-Y grid and are selectively illuminated, as directed by the graphics subsystem, for assembling an image, or a series of images (or frames) to create moving pictures.

Reference to a network adapter or network communications in this disclosure refers to a network interface device that enables the various computing systems to connect to the described network via a network bus, either wired or wireless. The network, which may be a local area network (LAN), a wide area network (WAN), an electronics communication network, i.e. the Internet, or the like, may utilize general purpose communication protocols that interconnect a plurality of network devices. The computing system is controlled and coordinated by operating system ("OS") software, such as, for exemplary purposes only, Windows®, Mac OSX, Apple iOS, Linux, Unix, Android OS, PalmOS, Windows Mobile OS, and the like. Among other functions, the OS controls allocation of system resources and performs tasks such as process scheduling, memory management, networking, and I/O services.

While specific embodiments have been described in detail, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A method for sensing the temperature of a refrigeration unit, comprising:

providing said refrigeration unit having an initial inside temperature below a threshold value;

providing one or more food products into said refrigeration unit;

providing into said refrigeration unit a temperature sensing unit, wherein said temperature sensing unit measures inside air temperature of said refrigeration unit;

establishing a communications link between said temperature sensing unit and a remote computing device, wherein said computing device is configured to determine thermal properties of said one or more food products;

transmitting from said temperature sensing unit to said remote computing device, temperature data corresponding to said inside air temperature of said refrigeration unit;

upon detection by said temperature sensing unit of a temperature above said threshold value, determining on said computing device based on said thermal properties, time needed for said one or more food products to spoil;

determining on said computing device based on said thermal properties, time needed for said one or more food products to return to said threshold value; and providing an alarm signal if said computing device determines that said time needed for said one or more food products to spoil is less than time needed for said one or more food products to return to said threshold value.

2. The method of claim 1, wherein said temperature sensing unit includes a transmitter comprising a network adapter.

3. The method of claim 1, wherein said computing device comprises a central processing unit, a database, and a computer program.

4. The method of claim 1, wherein said thermal properties are determined based on discharge air temperature of said refrigeration unit, specific heat of said food product, bulk density and moisture content of said food product, heat transfer coefficient of said food product, time intervals, surface area of aid food product, the volume of said food product, and combinations thereof.

5. The method of claim 1, including the step of:

activating an alarm if the temperature inside the refrigeration unit causes a rise of a selected actual product temperature above a specified threshold such as 41° F. while noting the time remaining to return the actual product temperature to a safe level within a specified time limit.

* * * * *